US006574886B1

(12) United States Patent
Issler

(10) Patent No.: US 6,574,886 B1
(45) Date of Patent: Jun. 10, 2003

(54) FOOTWEAR AND ITS METHOD OF CONSTRUCTION

(75) Inventor: James E. Issler, Greenwich, CT (US)

(73) Assignee: H.H. Brown Shoe Company, Inc., Greenwich, CT (US)

( * ) Notice: Subject to any disclaimer, the term of this patent is extended or adjusted under 35 U.S.C. 154(b) by 63 days.

(21) Appl. No.: 09/282,672

(22) Filed: Mar. 31, 1999

(51) Int. Cl.[7] ..... A43B 13/28; A43B 9/02; A43B 9/06

(52) U.S. Cl. ..... 36/12; 36/19 R; 36/22 R; 36/28; 36/37; 36/17 R; 36/17 PW; 12/142 C; 12/142 RS; 12/142 T

(58) Field of Search ..... 36/12, 91, 92, 36/103, 14, 15, 19 R, 25 R, 28, 30 R, 22 R, 31, 35 R, 36 A, 37, 44, 46.5, 17 R, 17 PW, 11.5; 12/142 RS, 142 T, 142 C, 142 D, 146 D, 146 BC, 146 BP

(56) References Cited

U.S. PATENT DOCUMENTS

| | | | | |
|---|---|---|---|---|
| 2,746,177 | A | | 5/1956 | Maccarone |
| 2,963,722 | A | | 12/1960 | Stix |
| 3,348,251 | A | | 10/1967 | Appleton et al. |
| 3,555,705 | A | | 1/1971 | Eder et al. |
| 3,705,463 | A | | 12/1972 | Lown |
| 4,430,767 | A | | 2/1984 | Allard |
| 4,662,018 | A | | 5/1987 | Autry |
| 4,704,808 | A | | 11/1987 | Bianchini et al. |
| 4,783,910 | A | * | 11/1988 | Boys, II et al. ..... 36/30 R |
| 4,794,707 | A | * | 1/1989 | Franklin et al. ..... 36/30 R |
| 5,068,983 | A | * | 12/1991 | Marc ..... 36/44 |
| 5,077,915 | A | * | 1/1992 | Gross ..... 36/30 R |
| 5,146,698 | A | * | 9/1992 | Tilles et al. ..... 36/44 |
| 5,199,191 | A | * | 4/1993 | Moumdjian ..... 36/28 |
| 5,224,277 | A | * | 7/1993 | Sang Do ..... 36/27 |
| 5,255,451 | A | * | 10/1993 | Tong et al. ..... 36/30 R |
| 5,311,674 | A | * | 5/1994 | Santiyanont et al. ..... 36/30 R |
| 5,493,792 | A | * | 2/1996 | Bates et al. ..... 36/28 |
| 5,729,917 | A | * | 3/1998 | Slepian et al. ..... 36/28 |
| 5,741,568 | A | * | 4/1998 | Rudy ..... 36/29 |
| 5,768,801 | A | * | 6/1998 | Huff ..... 36/17 R |
| 5,782,014 | A | * | 7/1998 | Peterson ..... 3/35 B |
| 5,784,736 | A | * | 7/1998 | Issler et al. ..... 36/12 |
| 5,893,186 | A | | 4/1999 | Issler et al. |
| 5,911,491 | A | * | 6/1999 | Huff ..... 36/17 R |

* cited by examiner

*Primary Examiner*—Anthony D. Stashick
(74) *Attorney, Agent, or Firm*—St. Onge Steward Johnston & Reens LLC

(57) ABSTRACT

Footwear and a method for its construction including the following features is provided. An upper which defines a volume for receiving a wearer's foot. A midsole which has an inner surface, an outer surface opposite to the inner surface, and an upstanding sidewall around its periphery. Stitching, which attaches the upper to the midsole along a peripheral portion of the upper and the sidewall of the midsole. An outsole, which has a walking surface and an attachment surface opposite to the walking surface. The outer surface of the midsole adhered to the opposed surface of the outsole.

22 Claims, 5 Drawing Sheets

FOOTWEAR AND ITS METHOD OF CONSTRUCTION

BACKGROUND OF THE INVENTION

The invention relates to footwear.

There are a wide variety of shoe constructions. One construction method, known as the Opanka construction method, includes hand-sewing an outsole of a shoe to an upper of the shoe along the entire outer periphery of the outsole. The Opanka construction method has typically been employed in constructing casual and sandal-type footwear. For this reason, producing a comfortable, soft-stepping shoe is an important quality for Opanka constructed footwear.

SUMMARY OF THE INVENTION

In a general aspect of the invention, a method for constructing footwear includes the following steps. An upper defining a volume for receiving a wearer's foot is provided. A midsole having an inner surface, an outer surface opposite to the inner surface, and an upstanding sidewall around its periphery is also provided. The upper is then attached to the midsole by stitching a thread along a peripheral portion of the upper and the sidewall of the midsole. An outsole, having a walking surface and an attachment surface opposite to the walking surface is then attached to the outer surface of the midsole adjacent to the attachment surface of the outsole. The outer surface of the midsole is then attached to the attachment surface of the outsole.

Embodiments of the invention may include one or more of the following additional steps. A channel is formed in the upstanding sidewall of the midsole, the channel extending from a peripheral-edge of the midsole in a direction parallel to the plane of the inner surface of the midsole, the channel sized to receive the thread for stitching the upper to the midsole. The channel serves to help hide and protect the thread used to attach the upper of a shoe to its midsole, giving the shoe a better appearance and a longer life.

A cavity is formed in at least the forward portion of the inner surface of the midsole and resilient material is positioned within that cavity. The resilient material within the cavity acts to cushion a wearer's foot and protects the wearer's foot (or sock) from excessive wear while walking.

A cavity is provided in the outer surface of the midsole and cushiony material is provided within that cavity. Footwear having such a cavity filled with cushiony material, be it a boot, a sandal, or a casual shoe, gives a greater spring-like, cushiony, and more comfortable feel to the wearer of the shoes. The cushiony material is high density polyurethane or latex foam which produces a more comfortable shoe.

A cut-but is provided in the midsole and cushiony material is positioned and maintained within that cut-out. In certain embodiments, the cushiony material includes woven material which may be elastic and is maintained within the cut-out by being stitched to the midsole. Such embodiments provide levels of spring-like comfort to the wearers of these shoes. The cushiony material provided within the cut-outs may also be made of a high density polyurethane or latex form.

In yet other embodiments of the invention one or more of the following steps may be present. The midsole is molded to possess a roughened outer surface to facilitate adhesively bonding the outer surface of the midsole to the attachment surface of the outsole.

The outsole is made of a single unitary member. Such an outsole made of a single unitary member advantageously provides flexibility for designing the shoes.

In another aspect of the invention, footwear includes an upper which defines a volume for receiving a wearer's foot; a midsole which has an inner surface, an outer surface opposite to the inner surface, and an upstanding sidewall around its periphery; stitching, which attaches the upper to the midsole along a peripheral portion of the upper and the sidewall of the midsole; and an outsole, which has a walking surface and an attachment surface opposite to the walking surface. The outer surface of the midsole is attached to the opposed surface of the outsole.

Embodiments of this invention may include one or more of the following additional features. A channel is formed in the upstanding sidewall of the midsole. The channel extends from a peripheral edge of the midsole in a direction parallel to the plane of the inner surface of the midsole. The channel is sized to receive a thread for stitching the upper to the midsole.

A cavity is formed in at least the forward portion of the inner surface of the midsole and is filled with resilient material to cushion a wearer's foot while walking.

A cavity is formed in the outer surface of the midsole and contains cushiony material to give a greater spring-like, cushiony, and more comfortable feel to the shoe's wearer. The cushiony material positioned within this cavity is made from a high density polyurethane or latex foam.

A cut-out in the midsole contains cushiony material including woven material which may also be elastic. Alternatively, the cushiony material is made from a high density polyurethane or latex foam. The cushiony material is secured within the cut-out by stitching the cushiony material to the midsole.

In yet other embodiments of the invention one or more of the following features may be present. The midsole is molded to have a roughened outer surface. The outsole is made of a single unitary member.

Footwear having the above arrangement advantageously uses a midsole to provide a flexible platform upon which different outsole styles and designs can be attached to a particular upper and midsole combination. Shoe manufacturers using this invention have greater flexibility in designing, creating, and assembling such shoes.

Other advantages of the above-described footwear and construction method include the ability to allow such shoes to be manufactured in separate stages or even at different locations. The invention also enables the construction of Opanka style shoes having an outsole made of any suitable outsole material e.g., rubber, TPR, PVC, EVA, etc.

Other advantages and features of the invention will be apparent from the following detailed description of presently preferred embodiments and from the claims.

DETAILED DESCRIPTION

Figure 1:
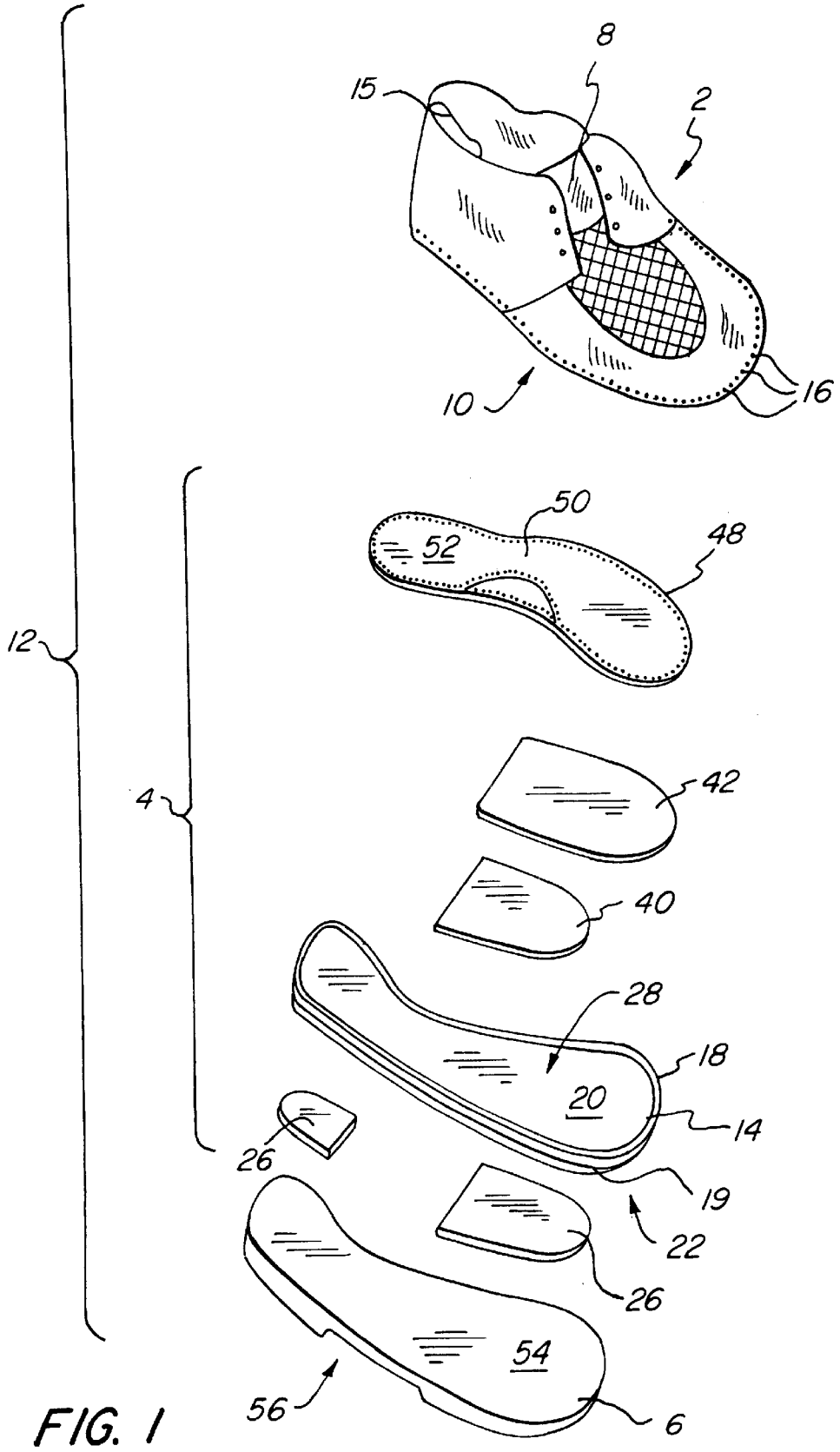
FIG. 1 is an exploded, perspective view of a shoe constructed in accordance with the invention.

Referring to FIG. 1, a shoe 12 includes an upper 2, a midsole assembly 4, and an outsole 6. Upper 2, preferably made from leather, has a tongue 8 extending into a vamp portion of the upper, and eyelets for receiving conventional front lacing (not shown). Upper 2 is shown free-floating, with its bottom portion 10 open to what will be the internal volume of the shoe. Upper 2 also includes an inner liner 15 which is sewn to the inner surface of upper 2 and is fabricated of materials (e.g., soft leather) selected to provide comfort to the wearer during walking. At this stage of construction, shoe 12 is said to be in the form of a sewn upper with bottom portions of both upper 2 and inner liner 15 open. Upper 2 further includes punched holes 16 around its periphery.

Midsole assembly 4 includes a midsole 14 as well as several support and cushiony materials described in greater detail below. Midsole 14 is preferably formed of molded polyurethane, with an integrally molded upstanding sidewall 18 extending around its periphery. Upstanding sidewall 18 contains a channel 19 extending from the peripheral edge of midsole 14 in a direction parallel to the plane of its inner surface (see FIG. 3). Midsole 14 also includes an inner surface 20, and an opposed outer surface 22 (FIG. 2), opposite to inner surface 20. Inner surface 20 and upstanding sidewall 18 together define a cavity 28 having a depth ranging from about 2 mm to about 4 mm.

Midsole assembly 4 further includes a cushioning layer 40 formed of polyurethane foam or like material having an uncompressed thickness of about 2 mm to 6 mm. Cushioning layer 40 is slightly smaller than cavity 28 providing a peripheral edge on inner surface 20 for adhesively securing the cushioning layer 40 within the cavity 28 using a relatively thin cover layer 42 formed of fiber or leather. A sock liner 48 has an inside layer 50 (shown in dashed lines) formed of a polyester material and covered by a top layer 52, e.g. of pigskin leather covering thin cover layer 42. In some embodiments, inside layer 50 may be decoratively quilted to provide an aesthetically pleasing look to the interior surface of the shoe.

Figure 2:
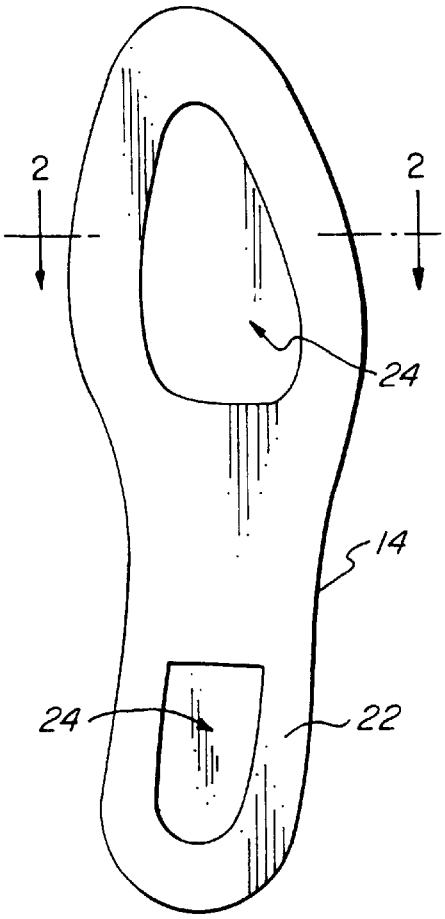
FIG. 2 is a bottom view of the midsole of the shoe.
Figure 3:
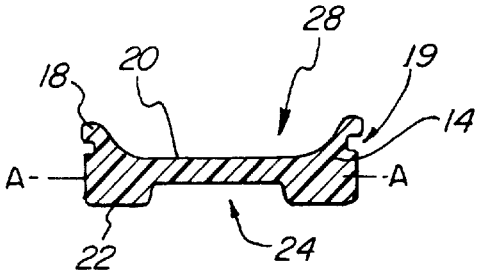
FIG. 3 is a cross-sectional view taken along the line 2—2 of FIG. 2.
Figure 4:
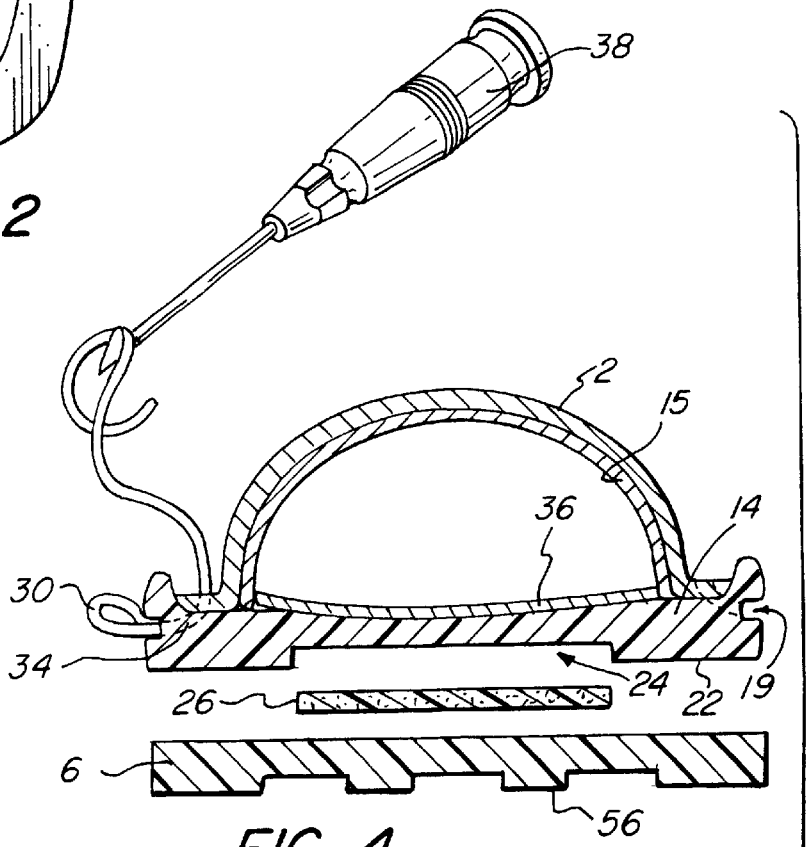
FIG. 4 is an exploded, cross-sectional view of a near completed shoe taken along the line 5—5 of FIG. 5.

Referring to FIG. 2, midsole 14 has an outer surface 22, opposite to inner surface 20, which preferably includes two cavities 24, one in the forepart and one in the heel. Cushiony inserts 26 as shown in FIGS. 1 and 4, are made from material such as high density polyurethane, latex foam or other suitable material, and are positioned within cavities 24 to provide additional comfort to the wearer of the shoes. Cushiony inserts 26 are cut to the same dimensions as cavities 24, but should be approximately 1/16 inches thicker than the depth of cavities 24, which are approximately 3/32 inches deep at their deepest point. This added thickness provides increased comfort and more of a spring-like feel to the wearer of shoe 12.

Cavities 24 are shaped to provide maximum cushion to the wearer of shoe 12, while also allowing sufficient area to attach outsole 6 to midsole 14. As is shown in FIG. 2, the preferred embodiment leaves approximately 3/4 to 7/8 inches between the outside edge of midsole 14 and the outside edge of cavity 24. This portion of outer surface 22 of midsole 14 is used to adhesively bond outsole 6 to midsole 14. Furthermore, outer surface 22 of midsole 14 is molded in such a fashion as to be sufficiently rough to permit bonding between outsole 6 and midsole 14.

Referring again to FIG. 1, outsole 6 includes a walking surface 56 and an attachment surface 54 opposite walking surface 56. Walking surface 56 may have designs and treads much like one typically finds on any shoe. In the preferred embodiment, attachment surface 54 is designed to be adhesively bonded to outer surface 22 of midsole 14.

The construction method of shoe 12 will now be described in conjunction with the FIGs.

Figure 6:
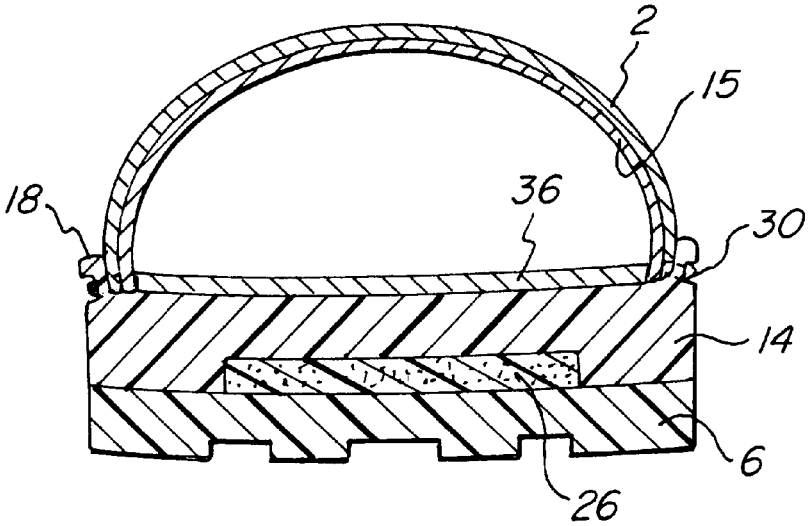
FIG. 6 is a cross-sectional view of the completed shoe taken along line 5—5 of FIG. 5.

In FIGS. 1 and 4, midsole assembly 4 is constructed by first inserting cushioning layer 40 within cavity 28 of midsole 14 and securing it therein by adhesively attaching cover layer 42 to inner surface 20. Next, sock liner 48 is placed within cavity 28 over cover layer 42. Together, these layers form resilient member 36, as shown in FIGS. 4 and 6. Next, as shown in FIG. 4, upper 2 is hand-sewn to midsole 14 using tool 38. Tool 38 is used to alternately stitch thread 30 through pre-punched holes 34 in midsole 4 and pre-punched holes 16 in upper 2 securing upper 2 to midsole 4.

After upper 2 has been sewn to midsole 14, cushiony inserts 26 are then positioned and spot cemented into cavities 24 of outer surface 22 of midsole 14. As will be described below, inserts 26 are permanently held in place by attaching outsole 6 to midsole 14.

Figure 5:
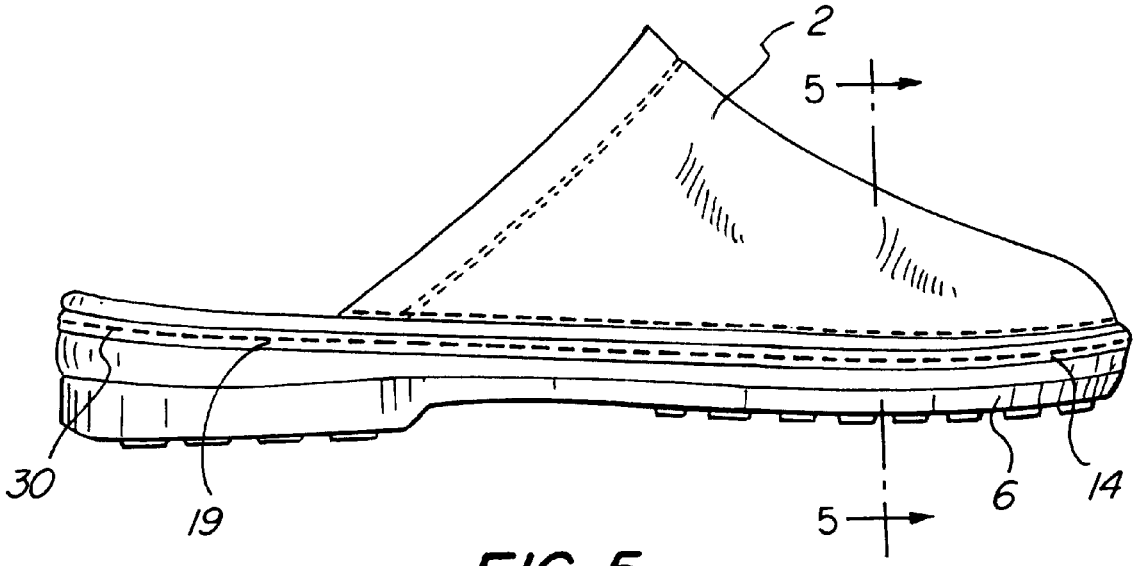
FIG. 5 is side view of a shoe completed in accordance with the invention.

To complete construction of shoe 12 in the preferred embodiment, attachment surface 54 of outsole 6 is adhesively bonded to the outer surface 22 of midsole 14. An embodiment of a completed shoe, here a sandal, is shown in FIG. 5. A completed cross-section of that shoe is shown in FIG. 6. Other embodiments of the invention are within the claims.

Figure 7:
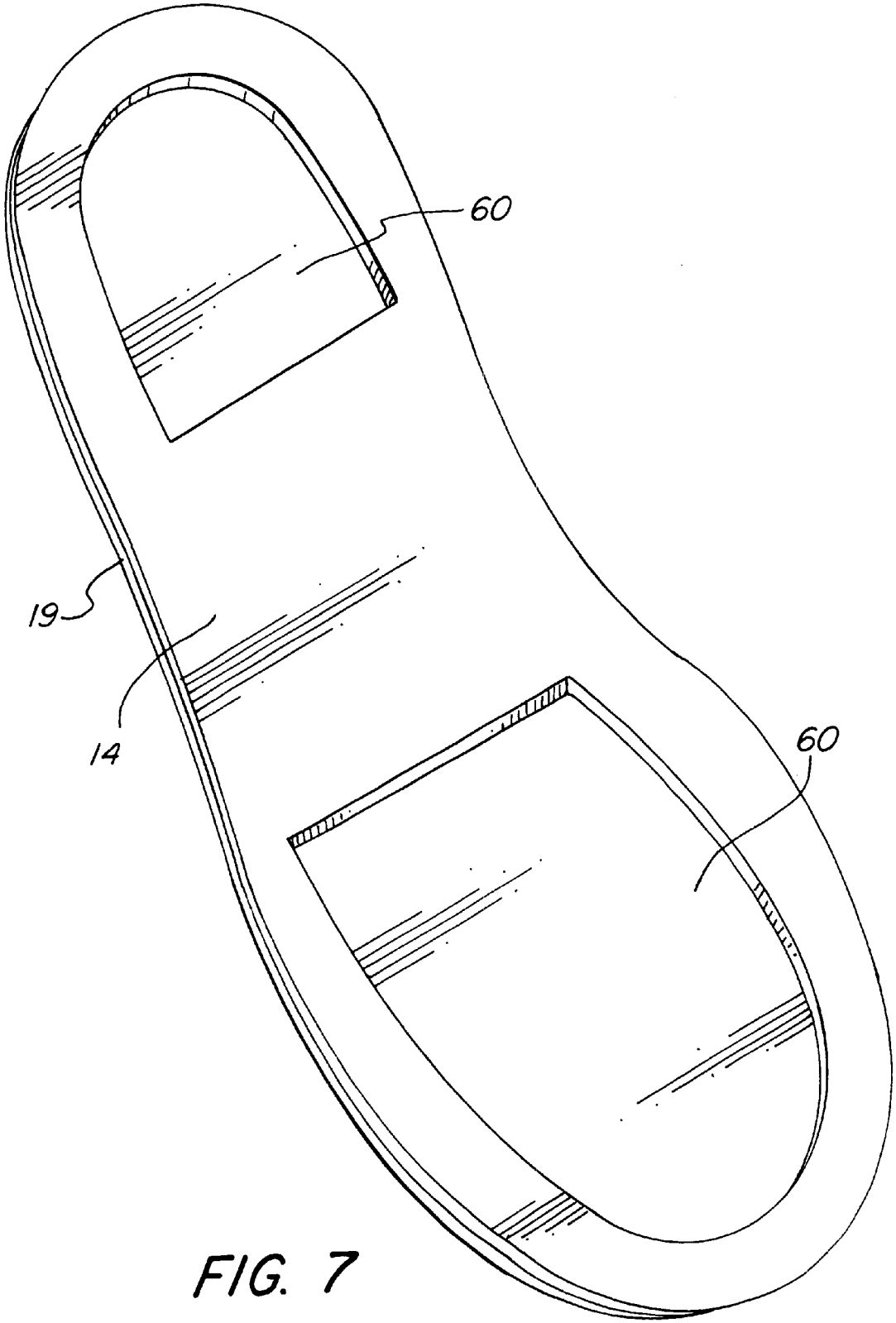
FIG. 7 is a perspective view of the bottom of a midsole of an alternate embodiment.
Figure 8:
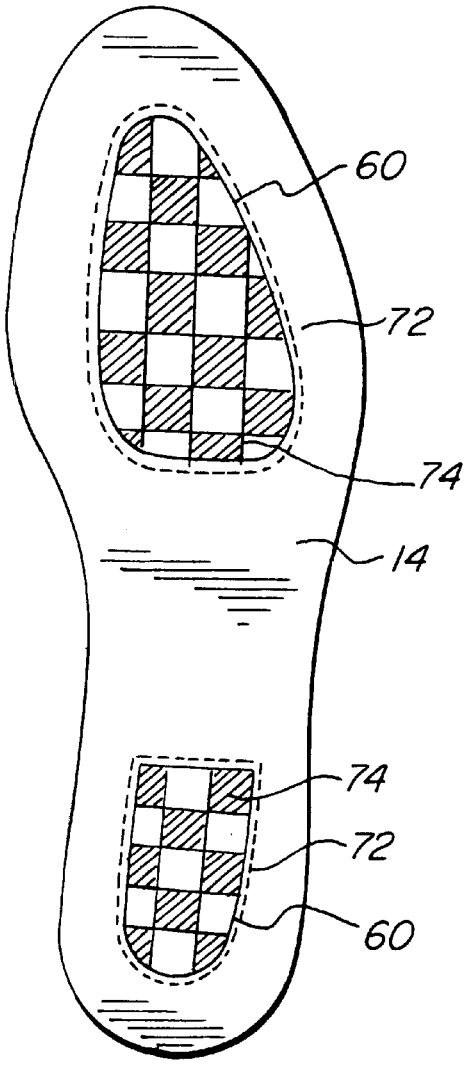
FIG. 8 is a bottom view of a midsole of an alternate embodiment showing woven cushiony material stitched into the midsole.

In another embodiment, as shown in FIGS. 7 and 8, the surface of cavities 24 are replaced by woven straps of elastic and rubbery cushiony material 74. To replace the surface of cavities 24 with this cushiony material 74, cut-outs 60 are created in midsole 4. Cut-outs 60 extend through midsole 14, leaving holes within it. In this embodiment cushiony material 74 is made up of bands of elastic and rubbery material, the bands having a width of not more then 5/8 inches, woven together and secured to midsole 14 by stitched thread 72.

Figure 9:
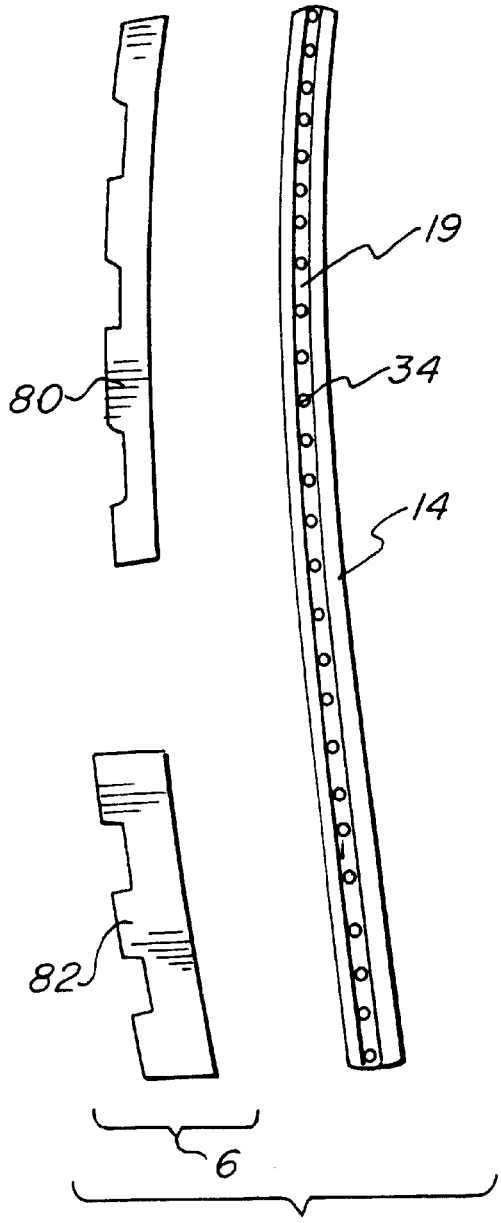
FIG. 9 is a side view of an alternate embodiment showing a midsole and an outsole consisting of a forepart and a rearpart.

In yet another preferred embodiment as shown in FIG. 9, outsole 6 consist of two or more separate pieces, forming a forepart 80 at the front of midsole 14 and a rearpart 82 at the heel of midsole 14. In this embodiment, midsole 14 has a finished surface, with perhaps a logo, trademark, or other design, on any exposed portion of outer surface 22 not covered by outsole 6.

Still other embodiments of the invention are within the following claims.

What is claimed is:

1. A method for construction of footwear comprising the steps of:

providing an upper defining a volume for receiving a wearer's foot, the upper having an open bottom;

providing a midsole having an upper surface enclosing the open bottom of the upper, an outer surface opposite to the upper surface, and an upstanding sidewall integrally molded with and around a periphery of the midsole;

attaching the upper to the midsole in a single stitching operation by stitching a thread along a peripheral portion of the upper and the sidewall of the midsole; and attaching an outsole having a walking surface and an attachment surface opposite to the midsole, the outer surface of the midsole positioned adjacent to the opposed attachment surface of the outsole.

2. The method of claim 1 further comprising:

forming a channel in the upstanding sidewall of the midsole, the channel extending from a peripheral edge of the midsole in a direction parallel to a plane of the inner surface of the midsole, the channel sized to receive the thread.

3. The method of claim 2 further comprising:

providing a cavity formed in at least a forward portion of the inner surface of the midsole; and positioning resilient material within the cavity formed in the inner surface of the midsole.

4. The method of claim 1 further comprising:

providing at least one cavity in the outer surface of the midsole; and positioning cushiony material within the cavity formed in the outer surface of the midsole.

5. The method of claim 4 wherein the cushiony material includes high density polyurethane.

6. The method of claim 1 further comprising:

providing at least one cut-out through the midsole;

positioning and maintaining cushiony material within the cut-out of the midsole.

7. The method of claim 6 wherein the cushiony material comprises woven material stitched to the midsole.

8. The method of claim 7 wherein the woven material is elastic.

9. The method of claim 6 wherein the cushiony material includes high density polyurethane.

10. The method of claim 1 wherein the midsole is molded to have a roughened outer surface.

11. The method of claim 1 wherein the outsole is a single unitary member.

12. Footwear comprising:

an upper defining a volume for receiving a wearer's foot and having an open bottom;

a midsole, having an upper surface enclosing the open bottom of the upper, an outer surface opposite to the upper surface, and an upstanding sidewall integrally molded with and around a periphery of the midsole;

a single stitching seam, attaching the upper to the midsole along a peripheral portion of the upper and the sidewall of the midsole; and an outsole, having a walking surface and an attachment surface opposite to the walking surface, the outer surface of the midsole attached to the attachment surface of the outsole.

13. The footwear of claim 12 further including:

a channel in the upstanding sidewall of the midsole extending from a peripheral edge of the midsole in a direction parallel to a plane of the inner surface of the midsole, the channel sized to receive a thread.

14. The footwear of claim 12 further including:

resilient material, secured within a cavity formed in the inner surface of the midsole.

15. The footwear of claim 12 further including:

cushiony material, secured within a cavity formed in the outer surface of the midsole.

16. The footwear of claim 15 wherein the cushiony material includes high density polyurethane.

17. The footwear of claim 15 wherein the cavity formed in the outer surface of the midsole is a cut-out extending through the midsole.

18. The footwear of claim 17 wherein the cushiony material secured within the cut-out comprises woven material stitched to the midsole.

19. The footwear of claim 18 where in the woven material is elastic.

20. The footwear of claim 12 wherein the outsole is a single unitary member.

21. The method of claim 1 wherein the outsole includes a front member and a separate heel member, the front member being attached to a front end of the outer surface of the midsole, the heel member being spaced from the front member and attached to a heel end of the outer surface of the midsole.

22. The footwear of claim 12 wherein the outsole includes a front member and a separate heel member, the front member being attached to a front end of the outer surface of the midsole, the heel member being spaced apart from the front member and attached to a heel end of the outer surface of the midsole.

* * * * *